US009067331B2

(12) United States Patent
Stang

(10) Patent No.: US 9,067,331 B2
(45) Date of Patent: Jun. 30, 2015

(54) WATERJET CUTTING SYSTEM FLUID CONDUITS AND ASSOCIATED METHODS

(75) Inventor: Darren Stang, Covington, WA (US)

(73) Assignee: OMAX Corporation, Kent, WA (US)

( * ) Notice: Subject to any disclaimer, the term of this patent is extended or adjusted under 35 U.S.C. 154(b) by 1074 days.

(21) Appl. No.: 13/078,429

(22) Filed: Apr. 1, 2011

(65) Prior Publication Data

US 2012/0247296 A1 Oct. 4, 2012

(51) Int. Cl.

| | |
|---|---|
| ***B26D 7/06*** | (2006.01) |
| ***B26F 3/00*** | (2006.01) |
| ***B26F 1/26*** | (2006.01) |
| ***B24C 1/04*** | (2006.01) |

(52) U.S. Cl.

CPC ..... *B26F 3/004* (2013.01); *Y10T 29/49428* (2015.01); *B26F 1/26* (2013.01); *B24C 1/045* (2013.01)

(58) Field of Classification Search

USPC ..... 285/125.1, 133.11; 83/99, 78, 98, 177; 239/587.1, 590

See application file for complete search history.

(56) References Cited

U.S. PATENT DOCUMENTS

| | | | | |
|---|---|---|---|---|
| 3,454,288 | A | 7/1969 | Mancusi | |
| 4,272,108 | A | 6/1981 | Maasberg | |
| 4,669,760 | A | 6/1987 | Hashish et al. | |
| 4,903,388 | A * | 2/1990 | Skonvall | 29/890.11 |
| 5,120,084 | A | 6/1992 | Hashimoto | |
| 5,172,939 | A | 12/1992 | Hashimoto | |
| 5,209,406 | A | 5/1993 | Johnson | |
| 5,979,945 | A * | 11/1999 | Hitachi et al. | 285/125.1 |
| 5,992,904 | A * | 11/1999 | Hitachi et al. | 285/332 |
| 6,213,095 | B1 * | 4/2001 | Asada et al. | 123/456 |
| 6,408,826 | B2 * | 6/2002 | Asada et al. | 123/468 |
| 6,450,546 | B1 | 9/2002 | Montgomery et al. | |
| 6,497,219 | B2 * | 12/2002 | Natsume | 123/468 |
| 6,544,012 | B1 | 4/2003 | Blume | |
| 6,860,517 | B2 * | 3/2005 | Sanders | 285/133.11 |
| 7,748,750 | B2 | 7/2010 | Raghavan et al. | |
| 2003/0146229 | A1 | 8/2003 | Munoz | |

OTHER PUBLICATIONS

IHS ESDU, "Guide to Stress Concentration Data," The Royal Aeronautical Society—The Institution of Mechanical Engineers, 64001 Issued Jun. 1976.

(Continued)

*Primary Examiner* — Omar Flores Sanchez
(74) *Attorney, Agent, or Firm* — Perkins Coie LLP

(57) ABSTRACT

Various embodiments of waterjet cutting systems are described herein. In one embodiment, a waterjet cutting system includes a waterjet cutting device coupled to a pressurized water source. The waterjet cutting device includes a waterjet cutting head and a fluid conduit configured to carry pressurized water to the waterjet cutting head. The fluid conduit has a wall defining a longitudinal passage through which the pressurized water travels. The fluid conduit also has a through hole extending from the outer surface of the wall to the longitudinal passage. The through hole has a cross-sectional shape with a maximum longitudinal dimension generally parallel to the longitudinal passage and a maximum latitudinal dimension generally perpendicular to the longitudinal passage. In one aspect of this embodiment, the maximum longitudinal dimension is greater than the maximum latitudinal dimension. Methods of forming fluid conduits according to various embodiments are also described herein.

11 Claims, 6 Drawing Sheets

(56) References Cited

OTHER PUBLICATIONS

Hydraulics & Pneumatics—Serving Fluid Power and Motion Control Engines Worldwide, http://www.hydraulicspneumatics.com/200/TechZone/FittingsCouplin/Article/True/6421/ , 2010, 2 pages.
OMAX Accessory Specifications A-Jet, Precision Abrasive Waterjet Accessories, Jan. 2010, 1 page.
Pilkey, Walter D., "Peterson's Stress Concentration Factors," Second Edition, John Wiley & Sons, Inc., Copyright 1997, pp. 175-185, 204-207, 211-216, 256-257, 284, 287-301, 318-322, 326, 362, 370.
Savin, G.N., "Stress Concentration Around Holes," Pergamon Press, 1961, pp. 72-80, 104-112, 123-142, 205-225.
Stephens, Ralph, et al., "Metal Fatigue in Engineering," Second Edition, John Wiley & Sons, Inc., Copyright 2001, Chapter 7, pp. 186-193.
Stress Concentration—Wikipedia, http://wikipedia.org/wiki/Stress_concentration, accessed Oct. 5, 2011, 3 pages.
Timoshenko, S. P., et al., "Theory of Elasticity," Third Edition, McGraw Hill Book Company, Copyright 1934, pp. 90-97, 181-194, 209-217.

* cited by examiner

WATERJET CUTTING SYSTEM FLUID CONDUITS AND ASSOCIATED METHODS

TECHNICAL FIELD

This application is directed to waterjet cutting systems and, more particularly, to waterjet cutting system fluid conduits, and methods associated with such waterjet cutting systems.

BACKGROUND

Waterjet cutting systems can include various types of fluid conduits that convey pressurized water. For example, a waterjet cutting system can include a fluid conduit through which pressurized water travels to a waterjet cutting head. Through holes, cross bores, or other features may be formed in the fluid conduit to allow the pressurized water to enter the conduit and/or for other purposes. Such features represent structural discontinuities which can experience elevated stress levels when the fluid conduit experiences cyclical or static pressurization. Such raised stresses in the vicinity of the discontinuities can lead to structural fatigue and reduce the useful life of the fluid conduit.

DETAILED DESCRIPTION

Figure 1:
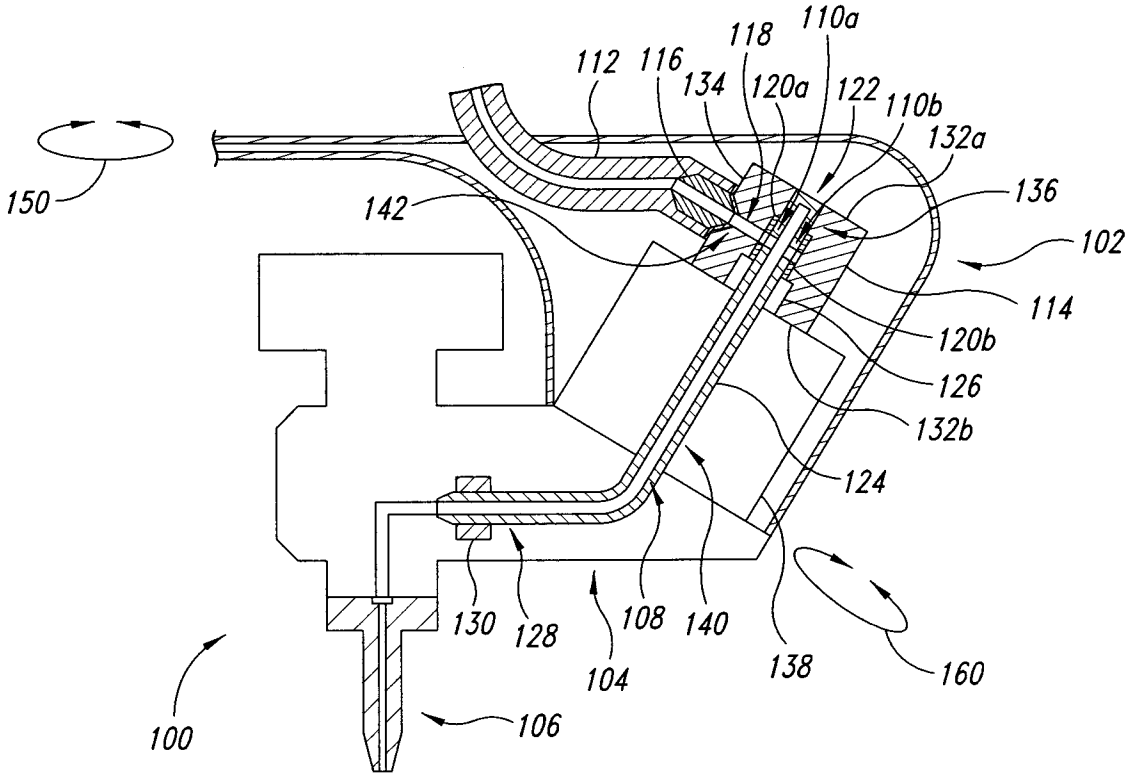
FIG. 1 is a partial cross-sectional side view of a waterjet cutting device having a fluid conduit configured in accordance with an embodiment of the disclosure.

Overall, the examples herein of some prior or related systems and methods and their associated aspects are intended to be illustrative and not exclusive. Other aspects of existing or prior systems and methods will become apparent to those of skill in the art upon reading the following Detailed Description.

This application describes various embodiments of waterjet cutting systems, including waterjet cutting systems utilizing fluid conduits having novel through hole configurations. Waterjet cutting systems as disclosed herein can be used with a variety of suitable working fluids or liquids to form the fluid jet. More specifically, cutting jet systems configured in accordance with embodiments of the present disclosure can include working fluids such as water, aqueous solutions, paraffins, oils (e.g., mineral oils, vegetable oil, palm oil, etc.), glycol, liquid nitrogen, and other suitable jet cutting fluids. As such, the term "water jet" or "waterjet" as used herein may refer to a cutting jet formed by any working fluid associated with the corresponding jet cutting system, and is not limited exclusively to water. In addition, although several embodiments of the present disclosure are described below with reference to water, other suitable working fluids can be used with any of the embodiments described herein. Certain details are set forth in the following description and in FIGS. 1-6 to provide a thorough understanding of various embodiments of the technology. Other details describing aspects of waterjet cutting systems, however, are not set forth in the following disclosure so as to avoid unnecessarily obscuring the description of the various embodiments.

Many of the details, dimensions, angles and other features shown in the Figures are merely illustrative of particular embodiments. Accordingly, other embodiments can have other details, dimensions, angles and features. In addition, further embodiments may be practiced without certain details described below.

In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1.

In one embodiment, a waterjet cutting system includes a waterjet cutting device coupleable to a pressurized water source of the waterjet cutting system. The waterjet cutting device includes a waterjet cutting head and a fluid conduit configured to carry pressurized water from the pressurized water source to the waterjet cutting head. The fluid conduit has a wall that defines a longitudinal passage through which the pressurized water travels. The fluid conduit also has a through hole extending from the outer surface of the wall to the inner surface of the wall. The through hole has a cross-sectional shape with a maximum longitudinal dimension generally parallel to the longitudinal passage and a maximum latitudinal dimension generally perpendicular to the longitudinal passage. The maximum longitudinal dimension and the maximum latitudinal dimension are both generally constant from the outer surface to the inner surface. The maximum longitudinal dimension is greater than the maximum latitudinal dimension.

In another embodiment, a fluid jet cutting device coupleable to a fluid jet cutting system includes a fluid jet cutting head and a housing coupled to the fluid jet cutting head. The housing includes a body and a fluid conduit extending through a central passage of the body to the fluid jet cutting head. The body has an outer surface and a fluid inlet aperture in the outer surface opening to a fluid inlet passage that extends to the central passage of the body. The fluid jet cutting device further includes a fluid conduit that has a first portion positioned within the central passage and a second portion coupled to the fluid jet cutting head. The first portion has one or more openings proximate to the fluid inlet passage. The fluid conduit also includes a longitudinal passage extending from the first portion to the second portion. Each of the one or more openings is in communication with the longitudinal passage. Each of the one or more openings has a cross-sectional shape with a maximum longitudinal dimension that is generally parallel to the longitudinal passage and a maximum latitudinal dimension that is generally perpendicular to the longitudinal passage. The sum of the maximum longitudinal dimensions is greater than the largest maximum latitudinal dimension.

In another embodiment, a balanced swivel includes a housing that includes a cavity and an inlet passage in communication with the cavity. The balanced swivel further includes a conduit, at least a portion of which is positioned within the cavity and is rotatably movable within the cavity with respect to the housing. The portion of the conduit includes a longitudinal passage and one or more openings proximate to the inlet passage. Each of the one or more openings is in communication with the longitudinal passage and has a maximum longitudinal dimension generally parallel to the longitudinal passage and a maximum latitudinal dimension generally perpendicular to the longitudinal passage. The sum of the maximum longitudinal dimensions is greater than the largest maximum latitudinal dimension.

In a further embodiment, a conduit includes a wall defining an axial passage configured to carry pressurized fluid or gas. The conduit also has at least one through hole in the wall. The at least one through hole has at least one maximum longitudinal dimension generally parallel to the axial passage and at least one maximum latitudinal dimension generally perpendicular to the axial passage. The at least one maximum longitudinal dimension is greater than the at least one maximum latitudinal dimension.

Waterjet Cutting System Fluid Conduits and Associated Methods

FIG. 1 is a partial cross-sectional side view of a waterjet cutting device 100 having a fluid conduit 124 configured in accordance with an embodiment of the disclosure. The waterjet cutting device 100 includes a first housing portion 102 that supports a second housing portion 104 which in turn supports a waterjet cutting head 106. The waterjet cutting device 100 can be coupled to a waterjet cutting system (not shown in FIG. 1). The first housing portion 102 can be configured to rotate with respect to the waterjet cutting system, as indicated by arrows 150. The waterjet cutting device 100 also includes a motor 138, and the second housing portion 104 is attached to the first housing portion 102 so as to allow the motor 138 to rotate the second housing portion with respect to the first housing portion 102, as indicated by arrows 160. Because portions of the waterjet cutting device 100 are rotatable, all or a portion of the waterjet cutting device 100 may be referred to as a swivel, a swiveling waterjet cutting device 100, or the like.

The fluid conduit 124 is generally tubular and has an open (or outlet) end portion 128 that is coupled to the waterjet cutting head 106. A holding device 130 (e.g., a fastener or any other suitable device) holds the open end portion 128 within an intermediate portion of the second housing portion 104. The fluid conduit 124 extends from the open end portion through a central passage 140 of the motor 138 to a capped end portion 136 that is positioned within a central passage or cavity 122 of a body 114. The central passage 122 extends from a first body surface 132*a* entirely through the body 114 to a second body surface 132*b*. The body 114 has a third surface 134, an opening 142 in the third surface 134, and a transverse water inlet passage 118 (alternatively referred to as a through hole, an aperture, a port, or the like) extending from the opening 142 to the central passage 122. The body 114 is coupled to a high-pressure water supply 112, and a seal 116 can provide for a sealed connection between the supply 112 and the body 114.

The fluid conduit 124 includes a longitudinal passage 108 extending from the capped end portion 136 to the open end portion 128 and two transverse through holes 110 (shown individually as through holes 110*a* and 110*b*) in the capped end portion 136. (The longitudinal passage 108 may be alternatively referred to as an axial passage and the through holes 110 may be alternatively referred to as cross-bores, apertures, passages, ports, or the like.) The two through holes 110 are perpendicular to the longitudinal passage 108. The fluid conduit 124 is positioned within the central passage 122 such that the two through holes 110 are generally aligned with the water inlet passage 118. The body 114 also includes two generally annular seal assemblies 120 (shown individually as annular seal assemblies 120*a* and 120*b*) that are positioned on either side of the two through holes 110 and that extend around or surround the fluid conduit 124. The body 114 further includes a fastener 126 (e.g., a threaded fastener) that holds the two seal assemblies 120 in place within the body 114. Because the fluid conduit 124 is rotatably movable within the central passage 122, the seals formed by the seal assemblies 120 can be considered dynamic seals. In some embodiments, the fluid conduit 124 can be fixedly positioned within the body 114 (or within similar structure), and the seal assemblies 120 can form a static seal. In some embodiments, the fluid conduit 124 can be fixedly coupled to another fluid conduit, fluid supply, or the like.

Figure 2A:
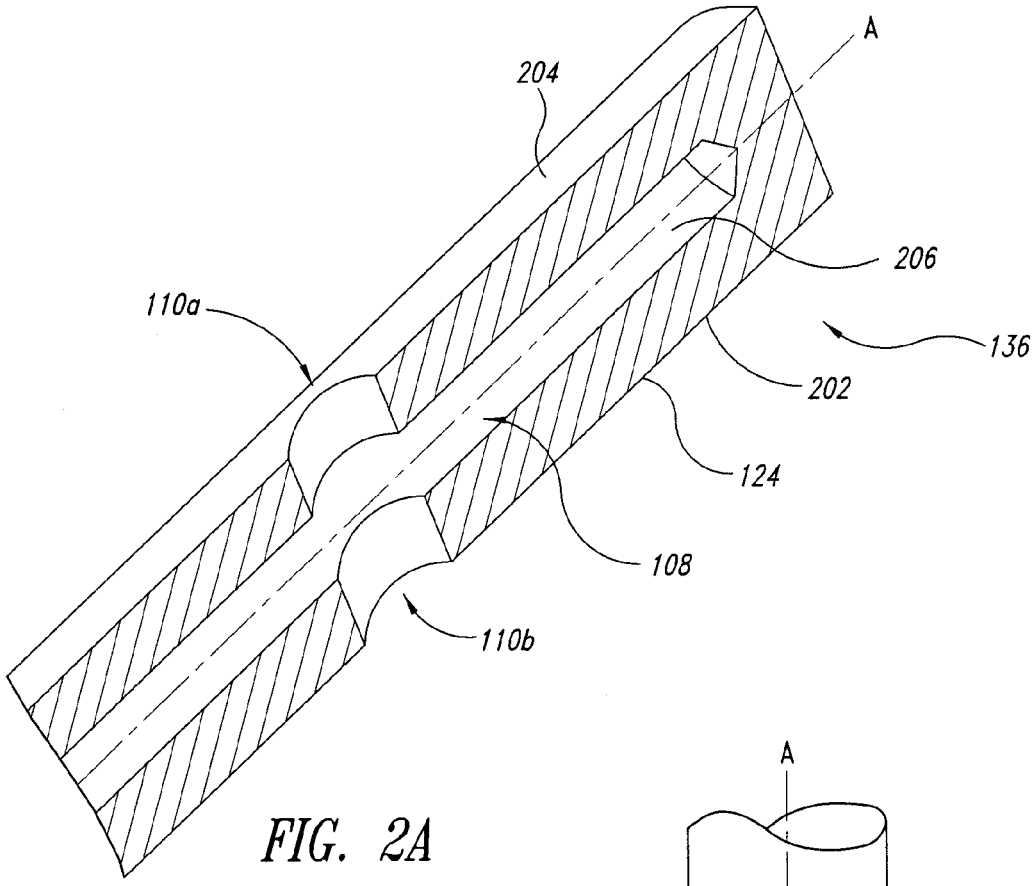
FIG. 2A is a cross-sectional isometric view of a portion of the fluid conduit of FIG. 1.
Figure 2B:
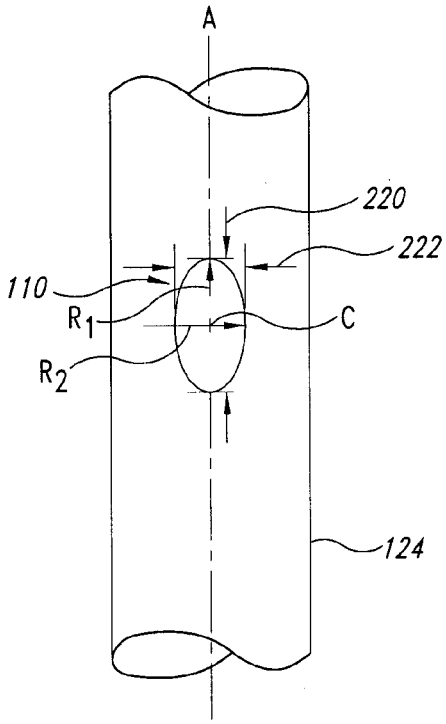
FIG. 2B is a side view of a portion of the fluid conduit of FIG. 1.

FIG. 2A is a cross-sectional isometric view of the capped end portion 136 of the fluid conduit 124 of FIG. 1, and FIG. 2B is a side view of a portion of the fluid conduit 124. The fluid conduit 124 includes a wall 202 having an outer surface 204 and an inner surface 206. The wall 206 defines the longitudinal passage 108, which is generally aligned with a longitudinal axis A of the fluid conduit 124, at least at the capped end portion 136. The wall 202 includes the first through hole 110*a* and the second through hole 110*b*. Both through holes 110 extend from the outer surface 204 to the inner surface 206 so as to permit communication of fluid to the longitudinal passage 108. The first and second through holes 110 are generally symmetrically aligned and are located in opposing portions of the wall 202 with respect to the longitudinal axis A. The two through holes 110 are not coaxial with the longitudinal axis A.

FIG. 2A illustrates the longitudinal passage 108 as a blind passage 108 at the capped end portion 136. In some embodiments, the longitudinal passage 108 is a through passage extending through the end of the fluid conduit 124. In such embodiments, a member (e.g., a threaded fastener) may be inserted into the longitudinal passage 108 to seal the longitudinal passage 108, and/or the capped end portion 136 may be sealed, covered, or otherwise configured such that the longitudinal passage 108 is blocked, so as to prevent fluid from escaping from the fluid conduit 124 via that end portion.

Referring next to FIG. 2B, in the illustrated embodiment each of the two through holes 110 has a generally elliptical cross-sectional shape. More specifically, each of the two through holes 110 has a first or longitudinal dimension 220 corresponding to the major axis of the generally elliptical cross-sectional shape. When measured along a line that passes through a center C of the through hole 110 that is parallel (or at least generally parallel) to the longitudinal axis A, the longitudinal dimension 220 is at a maximum. When measured in this fashion, the longitudinal dimension 220 is referred to as the maximum longitudinal dimension 220. Each through hole 110 also has a second or latitudinal dimension 222 corresponding to the minor axis of the generally elliptical cross-sectional shape. When measured along a line that passes through the center C that is perpendicular (or at least generally perpendicular) to the longitudinal axis A, the latitudinal dimension 222 is at a maximum. When measured in this fashion, the latitudinal dimension 222 is referred to as the maximum latitudinal dimension 222. In the illustrated embodiment, the maximum longitudinal dimension 220 and the maximum latitudinal dimension 222 are each constant going from the outer surface 204 to the inner surface 206 (FIG. 2A). In one aspect of this embodiment, the maximum longitudinal dimension 220 is greater than the maximum latitudinal dimension 222.

Referring to FIGS. 2A and 2B together, in the illustrated embodiment each of the through holes 110 has a first or major radius $R_1$ that is parallel with the longitudinal axis A and a second or minor radius $R_2$ that is orthogonal to the longitudinal axis A. The second radius $R_2$ is greater than the first radius $R_1$. The fluid conduit 124 is likely to experience the highest stresses in the axial direction at or proximate to the point where the maximum latitudinal dimension 222 intersects the perimeter of the through hole 110 (e.g., at a location of the intersection of the second radius $R_2$ at the perimeter of the through hole 110). Each through hole 110 has the largest latitudinal dimension 222 or second radius $R_2$ at or proximate to this intersection. As discussed in more detail herein, such a configuration can result in the fluid conduit 124 experiencing lower maximum stresses at this location than a fluid conduit having two opposing through holes with generally circular cross-sections.

According to additional features of the illustrated embodiment, the first through hole 110*a* has a first cross-sectional area $A_1$, the second through hole 110*b* has a second cross-sectional area $A_2$, and the longitudinal passage 108 has a third cross-sectional area $A_3$. In some embodiments, the sum of the first and second cross-sectional areas $A_1$ and $A_2$ of the two through holes 110 is generally equal to the third cross-sectional area $A_3$ of the longitudinal passage 108. In other embodiments, the sum of the first and second cross-sectional areas $A_1$ and $A_2$ can be less than or greater than the third cross-sectional area $A_3$.

Returning to FIG. 1, the waterjet cutting system to which the waterjet cutting device 100 can be coupled typically has a high-pressure water source (not shown in FIG. 1). In operation, the high-pressure water source provides pressurized water that travels through the high-pressure water supply 112 and the seal 116 before arriving at the body 114. The pressurized water travels through the opening 142 and the water inlet passage 118 of the body 114. The pressurized water can enter the fluid conduit 124 through one or both of the through holes 110. The pressurized water then travels through the longitudinal passage 108 to the waterjet cutting head 106.

The first housing portion 102 of the waterjet cutting device 100 can rotate (e.g., one or more revolutions in both clockwise and counter-clockwise directions) with respect to the waterjet cutting system and the motor 138 can cause the second housing portion 104 and the waterjet cutting head 106 to rotate (e.g., up to a certain number of degrees in both clockwise and counter-clockwise directions) with respect to the first housing portion 102. As the second housing portion 104 and the waterjet cutting head 106 rotate, the fluid conduit 124 rotates about the longitudinal axis A within the central passages 122 and 110 of the body 114 and the motor 138. As the fluid conduit 124 rotates, the two through holes 110 rotate away from or toward the water inlet passage 118. The two seal assemblies 120 prevent the water from escaping from the body 114, and the water is thereby forced to pass through one or both of the two through holes 110, even when one of the two through holes 110 is not directly facing the water inlet passage 118.

The fluid conduit 124 is subject to an internal pressure from the pressurized water traveling through the longitudinal passage 108. The fluid conduit 124 can also be subject to an external pressure proximate to the two through holes 110. The external pressure can partially or completely balance the internal pressure in the vicinity of the through holes 110. Accordingly, when pressurized water is flowing through the water inlet passage 118 to the central passage 122 and into the longitudinal passage 108 via the through holes 110, the fluid conduit 124 can be partially or completely balanced at portions of the fluid conduit 124 that are proximate to the two through holes 110, such as portions of the fluid conduit 120 between the first and second seal assemblies 120. Because portions of the fluid conduit 124 can be partially or completely balanced, all or a portion of the fluid conduit 124 may be referred to as a balanced fluid conduit 124. Similarly, all or a portion of the waterjet cutting device 100 may be referred to as a pressure balanced swivel, a balanced swivel, or the like.

The fluid conduit 124 is capped at the end portion 136 and therefore the internal pressure generates a tensile force along the longitudinal axis A. The axial tensile force acts to stretch or pull apart the two through holes 110 in such a manner as to increase the maximum longitudinal dimensions 220 (FIG. 2B). The fluid conduit 124 is likely to experience the highest stress concentrations along the perimeter of the two through holes 110 at the intersection of the perimeter and the maximum latitudinal dimension 222 (FIG. 2B). However, the radius of the through hole 110 (e.g., the second radius $R_2$ in FIG. 2B) is largest at this intersection. As a result, the peak stresses in this area are less than they would be if, for example, the through hole 110 had a circular cross-section (assuming equal or approximately equal cross-sectional areas). Therefore, the through hole 110 has the largest radius or radius of curvature at the point at which the fluid conduit 124 is likely to experience the highest stresses. Such a configuration of the fluid conduit 124 both ensures that more material is positioned at the points of highest stress and presents a more streamlined configuration for the stresses caused by the axial tensile forces.

The fluid conduit 124 can have an increased fatigue life in comparison to a fluid conduit having circular through holes that have the same (or at least generally the same) cross-sectional area as the through holes 110, while allowing the same (or at least generally the same) fluid volume flow. The fluid conduit 124 can be subjected to the same stresses (either cyclical, static, or some combination of cyclical and static) as a fluid conduit having circular through holes that have the same cross-sectional area, and the former should have a longer fatigue life than the latter. Accordingly, one advantage of waterjet cutting devices 100 utilizing fluid conduits 124 as described herein is an ability to operate for longer periods of time before replacing or repairing the fluid conduits 124.

Another advantage flows from the fluid conduit 124 experiencing lower peak stresses proximate to the two through holes 110. The fluid conduit 124 can be subjected to higher stresses (either cyclical, static, or some combination of cyclical and static) than a fluid conduit having circular through holes that have the same cross-sectional area, and the former fluid conduit can still have generally the same fatigue life (e.g., approximately the same mean time to failure) as the latter fluid conduit.

Instead of having the same (or at least generally the same) cross-sectional area as through holes having circular cross-sections, the two through holes 110 of the fluid conduit 124 could be configured to have a larger combined cross-sectional area. Such a configuration would allow for greater volume fluid flow through the two through holes 110. The two through holes 110 could be configured so as to provide the fluid conduit 124 with approximately the same fatigue life as a fluid conduit having through holes with circular cross-sections. One advantage of such a configuration would be that the fluid conduit 124 would likely have approximately the same fatigue life but would allow for greater volume fluid flow.

Figure 3A:
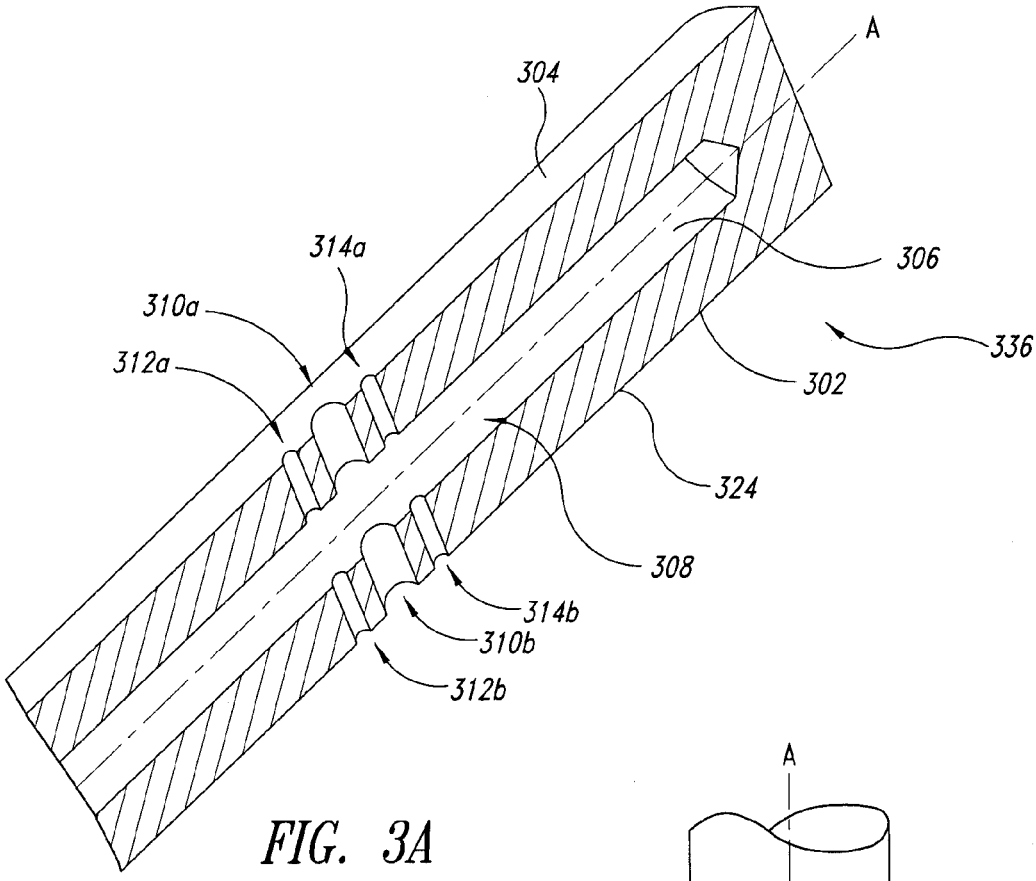
FIG. 3A is a cross-sectional isometric view of a portion of a fluid conduit configured in accordance with another embodiment of the disclosure.
Figure 3B:
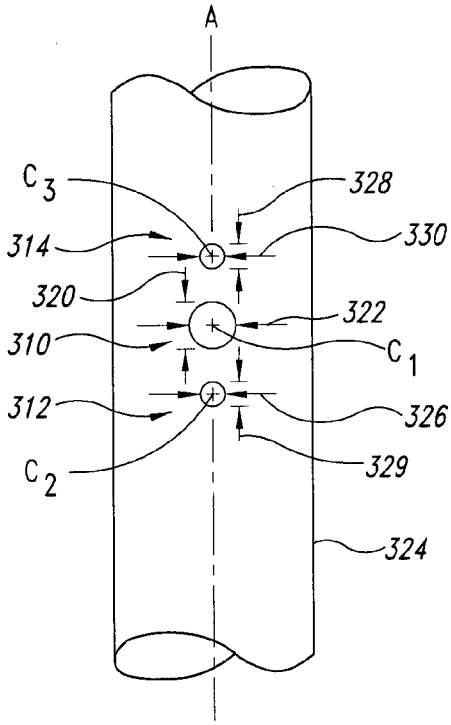
FIG. 3B is a side view of a portion of the fluid conduit of FIG. 3A.

FIG. 3A is a cross-sectional isometric view of an end portion 336 of a fluid conduit 324 configured in accordance with another embodiment of the disclosure and FIG. 3B is a side view of a portion of the fluid conduit 324. The fluid conduit 324 includes a wall 302 having an outer surface 304 and an inner surface 306. The wall 302 defines a longitudinal passage 308 that is generally parallel with a longitudinal axis A of the fluid conduit 324. The fluid conduit 324 includes a first set of three circular through holes 310*a*, 312*a*, and 314*a* extending from a first portion of the outer surface 304 to a first portion of the inner surface 306. The fluid conduit 324 also includes a second set of three circular through holes 310*b*, 312*b*, and 314*b* extending from a second portion of the outer surface 304 to a second portion of the inner surface 306. The through holes 310, 312, and 314 are perpendicular to the longitudinal axis A. The first set of through holes 310*a*, 312*a*, and 314*a* and the second set of through holes 310*b*, 312*b*, and 314*b* are symmetrically located in opposing portions of the wall 302 with respect to the longitudinal axis A.

As can be seen in FIG. 3B, the three circular through holes 310, 312, and 314 are longitudinally aligned (along the longitudinal axis A). The first through hole 310 has a maximum longitudinal dimension 320 (corresponding to the diameter of the circular cross-section) that passes through a center $C_1$ of the through hole 310 and that is parallel (or at least generally parallel) to the longitudinal axis A. The first through hole 310 also has a maximum latitudinal dimension 322 (also corresponding to the diameter of the circular cross-section) that passes through the center $C_1$ and that is perpendicular (or at least generally perpendicular) to the longitudinal axis A. The second 312 and third 314 through holes have respective maximum longitudinal 329/328 and latitudinal 326/330 dimensions. Because each of the three through holes 310, 312, and 314 has a circular cross-section, the maximum longitudinal dimension is equal to the maximum latitudinal dimension for each. However, the sum of the maximum longitudinal dimensions 320, 329, and 328 is greater than the largest maximum latitudinal dimension (the maximum latitudinal dimension 322 of the through hole 310) of an of the individual the three through holes 310, 312, and 314. Although none of the three through holes 310, 312, and 314 is elliptical, the overall configuration of the three through holes 310, 312, and 314 can approximate an elliptical or generally elliptical shape.

The configuration of the three through holes 310, 312, and 314 can accordingly provide at least some of the increased resistance to stresses as described above with reference to the configuration of the two elliptical through holes 110 of the fluid conduit 124. Accordingly, one advantage of the fluid conduit 324 is an increased fatigue life in comparison to a fluid conduit having two opposing through holes having circular cross-sections with the same cross-sectional area as the combined cross-sectional areas of the through holes 310, 312, and 314, while still allowing the same (or at least generally the same) fluid volume flow through the through holes 310, 312, and 314. Another advantage of the fluid conduit 324 illustrated in FIGS. 3A and 3B is that circular through holes 310, 312, and 314 can be easier to form and therefore, it can be easier to manufacture the fluid conduit 324. Another advantage is that the fluid conduit 324 can be subjected to higher stresses (either cyclical, static, or some combination of cyclical and static) than a fluid conduit having a single circular through hole that has the same cross-sectional area, and the former fluid conduit can still have generally the same fatigue life (e.g., approximately the same mean time to failure) as the latter fluid conduit.

Figure 4C:
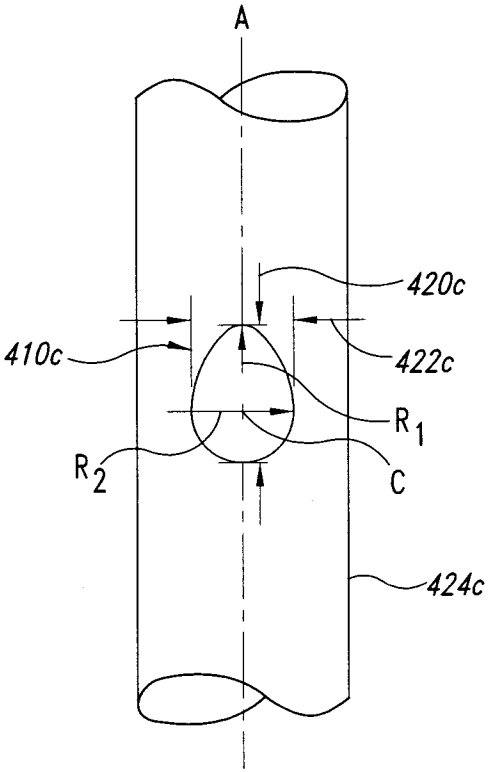
FIGS. 4A-4C are side views of portions of fluid conduits configured in accordance with other embodiments of the disclosure.
Figure 4B:
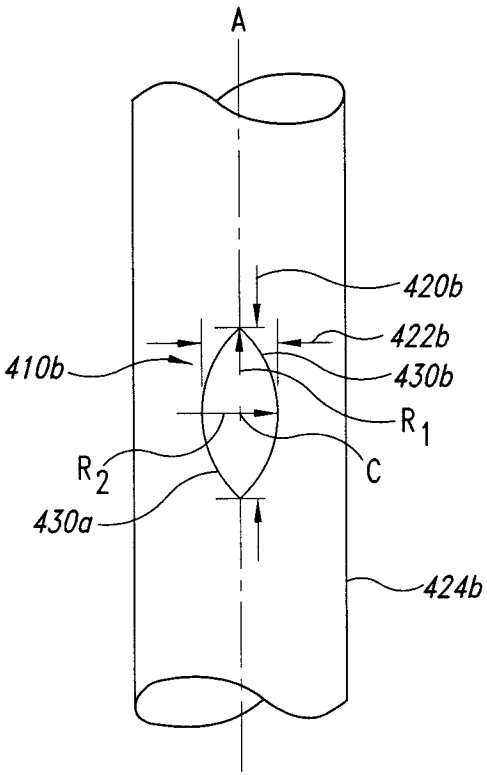
Figure 4A:
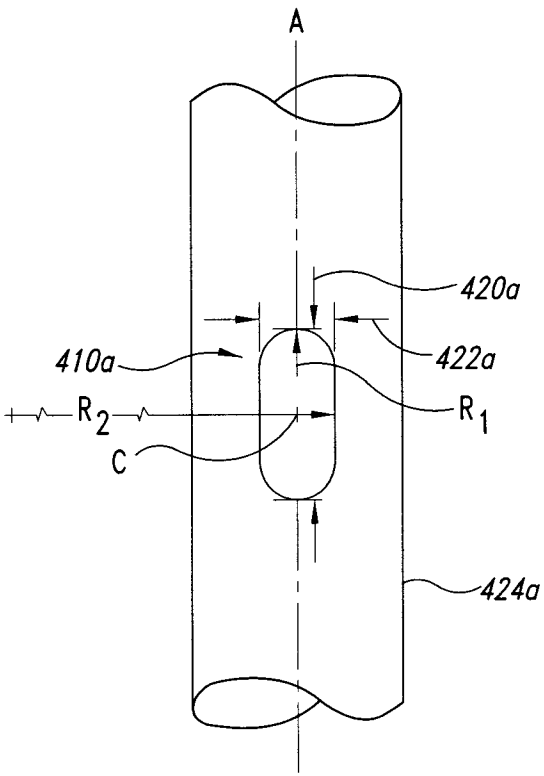

FIGS. 4A-4C are side views of portions of fluid conduits configured in accordance with other embodiments of the disclosure. FIG. 4A illustrates a fluid conduit 424*a* having a through hole 410*a* with a stadium or oval shaped cross-section (e.g., similar to a rectangle having semicircular ends). FIG. 4B illustrates a fluid conduit 424*b* having a through hole 410*b* with a cross-section defined by two symmetrical intersecting arcs 430*a* and 430*b*. FIG. 4C illustrates a fluid conduit 424*c* having a through hole 410*c* with an oval, ovoid, or egg-shaped cross-section. Each of the through holes 410 illustrated in FIGS. 4A-4C has a corresponding maximum longitudinal dimension 420 (shown individually as maximum longitudinal dimensions 420*a*-420*c* in FIGS. 4A-4C, respectively) that passes through a center C of the corresponding through hole 410 and that is parallel (or at least generally parallel) to a longitudinal axis A of the corresponding fluid conduit 424. Each of the through holes 410 also has a corresponding maximum latitudinal dimension 422 (shown individually as maximum latitudinal dimensions 422*a*-422*c* in FIGS. 4A-4C, respectively) that passes through the center C and that is perpendicular (or at least generally perpendicular) to the corresponding longitudinal axis A. For each of the through holes 410, the maximum longitudinal dimension 420 is greater than the maximum latitudinal dimension 422. Accordingly, the fluid conduits 424 can provide resistance to axial tensile stresses similar to the resistance provided by the fluid conduits 124, 324 described above with reference to FIGS. 2A-3B.

According to additional features of the illustrated embodiment, the through hole 410*a* has a first dimension or radius $R_1$ that is parallel to the longitudinal axis A and a second dimension or radius $R_2$ that is perpendicular to the longitudinal axis A. Because the first through hole 410*a* has a stadium shaped cross-section with generally linear sides of the first through hole 410*a* being parallel to the longitudinal axis A, the second radius $R_2$ can be very large or infinite. Referring next to FIG. 4B, the second through hole 410*b* has a first dimension or radius $R_1$ that is parallel to the longitudinal axis A and a second dimension or radius $R_2$ that is perpendicular to the longitudinal axis A. Because the second through hole 410*b* has a cross-section defined by two symmetrical intersecting arcs, the first dimension $R_1$ can be very small or zero. Referring next to FIG. 4C, the third through hole 410*c* has a first dimension or radius $R_1$ that is parallel to the longitudinal axis A and a second dimension or radius $R_2$ that is perpendicular to the longitudinal axis A and greater than the first radius $R_1$. For each through hole 410 illustrated in FIGS. 4A-4C, the second radius $R_2$ is greater than the first radius $R_1$. As noted above, the fluid conduits 424 are likely to experience the highest stresses in the axial direction at or proximate to the point where the maximum latitudinal dimension 422 intersects the perimeter of the through hole 410 (e.g., at the intersection of the second radius $R_2$ and the perimeter of the through hole 410). At this location, each through hole 410 has the largest second radius or dimension $R_2$. Such configurations should result in the fluid conduits 424 experiencing lower maximum stresses than a fluid conduit having through holes with generally circular cross-sections.

Two finite element (FE) analyses were performed on three models of fluid conduits. A first model had two opposing through holes with generally elliptical cross-sections, similar to the configuration illustrated in FIGS. 1-2B. A second model had opposing sets of three circular through holes, similar to the configuration illustrated in FIGS. 3A and 3B. A third model had two opposing through holes with circular cross-sections. In each model, the total cross-sectional area of the through holes was generally equal to the cross-sectional area of the longitudinal passage of the fluid conduit. Moreover, the total cross-sectional area of the through holes of each of the models was also kept approximately equal so as to ensure conditions corresponding to approximately equal fluid volume flow for the three models.

A first FE analysis subjected all three models to stresses similar to that which a similarly configured fluid conduit would likely experience during operation of a waterjet cutting device containing the fluid conduit. That is, each model was subjected to external pressure at the external surfaces of the fluid conduit proximate to the through holes, internal pressure at the internal surfaces of the fluid conduit, and axial tensile stresses. The FE analysis revealed that the first model (with two opposing elliptical cross-section through holes) improved or reduced a maximum stress in the axial direction by approximately 15% to approximately 25% of the maximum stress experienced by the third model. The FE analysis further revealed that the second model (with two sets of three opposing through holes) may slightly improve or reduce the maximum stress in the axial direction up to approximately 10% of the maximum stress experienced by the third model. Accordingly, the first and second models experienced less maximum stress (e.g., approximately 15-25% less maximum stress for the first model and up to approximately 10% less maximum stress for the second model) in the axial direction than that experienced by the third model. Such FE analysis indicates that fluid conduits configured according to embodiments of the present disclosure should have greater fatigue resistances and longer useful lives than a fluid conduit configured according to the third model.

A second FE analysis involved performing an autofrettage procedure on each model to induce internal compressive stresses prior to subjecting each model to likely actual pressures. In the autofrettage procedure, each model was subjected to a pressure exceeding that of the pressures a similarly configured fluid conduit would likely experience during operation of a waterjet cutting device containing the fluid conduit. Each model was then subjected to stresses similar to that which a similarly configured fluid conduit would likely experience during operation of a waterjet cutting device containing the fluid conduit, as described in the preceding paragraph.

The second FE analysis revealed that the third model (with two circular cross-section through holes) generally experienced the greatest maximum stress in the axial direction. However, the maximum axial stress experienced by the third model in the second FE analysis was reduced or improved by approximately 80% of the maximum axial stress experienced by the third model in the first FE analysis. Moreover, in the second FE analysis, the first model (with two opposing elliptical cross-section through holes) experienced a reduced or improved maximum stress in the axial direction by approximately 135% to approximately 145% of the maximum stress in the axial direction experienced by the third model. In addition, the maximum axial stress experienced by the first model in the second FE analysis was also reduced or improved by approximately 100% to approximately 110% of the maximum axial stress experienced by the third model in the first FE analysis. Furthermore, in the second FE analysis, the second model (with two sets of three opposing through holes) experienced a maximum stress in the axial direction that was reduced or improved by approximately 10% to approximately 20% of the maximum stress in the axial direction experienced by the third model. In addition, the maximum axial stress experienced by the second model in the second FE analysis was also reduced or improved by approximately 80% to approximately 90% of the maximum axial stress experienced by the third model in the first FE analysis. Accordingly, the first and second FE analyses indicate at least two aspects: 1) that fluid conduits configured according to the first and second models will likely have greater fatigue resistance and longer useful lives than a fluid conduit configured according to the third model; and 2) that fluid conduits configured according to the first and second models and that have undergone an autofrettage procedure should experience maximum axial stresses that are less than those experienced by similarly configured fluid conduits that have not undergone an autofrettage procedure and are configured according to the model. Moreover, autofrettaged fluid conduits configured according to the first model remain in compression at the location where the axial stresses were measured in the first and second FE analyses as evidenced by the greater than 100% improvements over the third model.

Table 1 summarizes the results of the first and second FE analyses.

TABLE 1

| | First FE analysis | Second FE analysis (autofrettaged) | |
|---|---|---|---|
| Model | (non-autofrettaged) Approximate % Improvement over Third Model | Approximate % Improvement over Third Model | Approximate % Improvement over Third Model in first FE analysis |
| First Model | 15%-25% | 135%-145% | 100%-110% |
| Second Model | 0%-10% | 10%-20% | 80%-90% |
| Third Model | 100% | 100% | 80% |

The results in Table 1 indicate that fluid conduits having two opposing through holes with generally elliptical cross-sections (e.g., FIGS. 1-2B) will likely experience lower maximum stresses in the axial direction than fluid conduits having two opposing through holes with circular cross-sections. In the two FE analyses, in both of the models, the total cross-sectional area of the two through holes was generally equal to the cross-sectional area of the longitudinal passage. For fluid conduits where the total cross-sectional area of the two through holes is less than the cross-sectional area of the longitudinal passage, fluid conduits having two opposing through holes with generally elliptical cross-sections should also experience lower maximum axial stresses than fluid conduits having two opposing through holes with circular cross-sections.

Similarly, for fluid conduits where the total cross-sectional area of the two through holes is greater than the cross-sectional area of the longitudinal passage, fluid conduits having two opposing through holes with generally elliptical cross-sections should also experience lower maximum axial stresses than fluid conduits having two opposing through holes with circular cross-sections. In other words, regardless of whether the total cross-sectional area of the two through holes is less than, generally equal to, or greater than the cross-sectional area of the longitudinal passage, fluid conduits having two opposing through holes with generally elliptical cross-sections should experience lower maximum axial stresses than fluid conduits having two opposing through holes with circular cross-sections.

In the two FE analyses, the models with the two opposing through holes with generally elliptical cross-section exhibited favorable characteristics. Fluid conduits having two sets of multiple through holes configured as illustrated in FIGS. 3A and 3B (or in similar configurations) should also exhibit favorable characteristics. That is, fluid conduits with such other configurations should experience maximum axial stresses that are less than those experienced by fluid conduits having two opposing through holes with circular cross-sections. Such reduction in maximum axial stresses should be obtained regardless of whether the total cross-sectional area of the two through holes is less than, generally equal to, or greater than the cross-sectional area of the longitudinal passage.

Fluid conduits having two opposing through holes configured as illustrated in FIGS. 4A-4C (or in similar configurations) should also exhibit favorable characteristics. That is, fluid conduits with such other configurations should experience maximum axial stresses that are less than those experienced by fluid conduits having two opposing through holes with circular cross-sections. Such reduction in maximum axial stresses should be obtained regardless of whether the total cross-sectional area of the two through holes is less than, generally equal to, or greater than the cross-sectional area of the longitudinal passage.

Fluid conduits having a single through hole having a generally elliptical cross-section should exhibit favorable characteristics. That is, fluid conduits with a single through hole with a generally elliptical cross-section should experience maximum stresses in the axial direction that are less than those experienced by fluid conduits having a single through hole with a circular cross-section. Such reduction in maximum axial stresses should be obtained regardless of whether the cross-sectional area of the single through hole is less than, generally equal to, or greater than the cross-sectional area of the longitudinal passage.

Similarly, fluid conduits having a single through hole configured as illustrated in FIGS. 4A-4C (or in similar configurations), or a single set of multiple through holes configured as illustrated in FIGS. 3A and 3B (or in similar configurations) should experience maximum axial stresses that are less than those experienced by fluid conduits having a single through hole with a circular cross-section. Such reduction in maximum axial stresses should be obtained regardless of whether the cross-sectional area of the single through hole (or single set of multiple through holes) is less than, generally equal to, or greater than the cross-sectional area of the longitudinal passage.

This disclosure describes fluid conduits with though holes having non-circular cross-sections (e.g., FIGS. 2A and 2B and FIGS. 4A-4C). Such fluid conduits are configured so that the portion of the through hole having the largest radius is at or proximate to the point where the highest stresses are likely to occur. In such fluid conduits, the largest radius of the through hole is orthogonal to the axial tensile forces experienced by the fluid conduits. Such configurations can provide decreased maximum stress in the axial direction in comparison to a fluid conduit having two opposing through holes with circular cross sections.

This disclosure also describes fluid conduits with sets of multiple though holes having circular cross-sections of multiple radii (e.g., FIGS. 3A and 3B). Such fluid conduits have multiple through holes, each of which has an unvarying radius, but whose radii can vary from through hole to through hole. Such configurations can also provide decreased maximum stress in the axial direction in comparison to a fluid conduit having two opposing circular cross section through holes. This disclosure is intended to encompass fluid conduits having a configuration of one or more through holes of varying radii, a combination of radiused and straight segments, or any other suitable combination of through holes. Put another way, this disclosure is intended to encompass fluid conduits having through holes configured such that the radius that is oriented perpendicular to applied axial tensile stresses is of a greater radius than the radius oriented parallel to the applied axial tensile stresses.

This disclosure is also intended to encompass fluid conduits that have a single through hole where the through hole is configured such that the portion of the through hole having the largest radius is at or proximate to the point where the highest stresses are likely to occur. In such fluid conduits, the largest radius is orthogonal to the axial tensile forces experienced by the fluid conduits. As previously noted, such a single through hole is expected to experience maximum stresses in the axial direction that are less than the maximum stresses in the axial direction experienced by a single through hole having a circular cross-section. Such reduction in maximum axial stresses is expected regardless of whether the cross-sectional area of the single through hole is smaller than, equal to, or greater than the cross-sectional area of the longitudinal passage.

Figure 5:
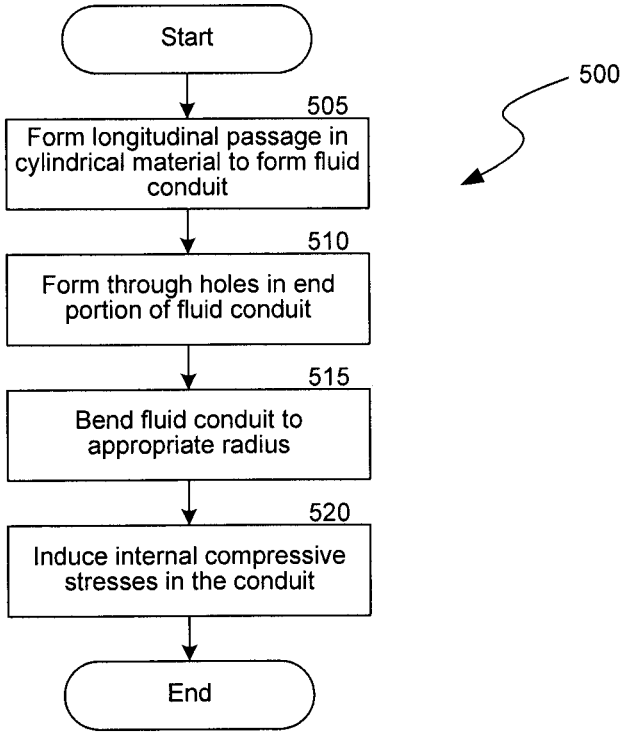
FIG. 5 is a flow diagram of a process for forming a fluid conduit in accordance with an embodiment of the disclosure.

FIG. 5 is a flow diagram of a process 500 for forming a fluid conduit in accordance with an embodiment of the disclosure. The process 500 begins at step 505, where a longitudinal passage is formed in generally cylindrical material that has the appropriate dimensions (e.g., the same outside diameter and length as the fluid conduit should have). The longitudinal passage may be formed by any suitable technique, such as by gun drilling, reaming, or by some combination of these techniques. Forming the longitudinal passage forms the fluid conduit. The longitudinal passage may extend through the entirety of the fluid conduit, or the longitudinal passage may be a blind passage, in that the longitudinal passage does not extend entirely through the fluid conduit. For the former case, the fluid conduit has a generally annular cross-section from a first end to a second end. For the latter case, the fluid conduit has a generally annular cross-section from a first end to an intermediate portion of the fluid conduit.

At step 510, the through holes (e.g., either the two through holes having generally elliptical cross-sections or the two sets of three through holes having circular cross-sections) are formed in an end portion of the fluid conduit (e.g., in an end portion whose end is capped, or in an end portion whose end is open but is to be sealed off). The through holes may be formed by any suitable technique, such as by broaching, milling, electric discharge machining (EDM), or by use of abrasive waterjet cutting. If the latter technique is utilized to form the through holes, the through holes can be formed using one of two methods.

In a first method, generally cylindrical material having an outside diameter that is smaller than the inside diameter of the longitudinal passage is inserted into the longitudinal passage. The cylindrical material can be made of any suitable material (e.g., stainless steel, tungsten carbide, etc.). The abrasive waterjet forms the first through hole (or first set of through holes) in a first wall portion of the fluid conduit in a first cutting operation. The fluid conduit is then rotated so that a second opposing wall portion of the fluid conduit faces the abrasive waterjet cutting head. The abrasive waterjet then forms the second through hole (or second set of through holes) in the second opposing wall portion of the fluid conduit in a second cutting operation.

In the second method, generally cylindrical material having an outside diameter that is smaller than the inside diameter of the longitudinal passage is inserted into the longitudinal passage. The cylindrical material can be made of any suitable material (e.g., aluminum or other suitable material). The abrasive waterjet forms the first and second through holes in a single cutting operation in which the abrasive waterjet passes through a first wall portion of the fluid conduit, through the cylindrical material, and then through a second opposing wall portion of the fluid conduit. In embodiments where the fluid conduit has two sets of three through holes (e.g., FIG. 2, At step 515, the fluid conduit is bent to an appropriate radius. At step 520, internal compressive stresses can be induced in the fluid conduit. In certain embodiments, the compressive stresses can be induced by autofrettaging the conduit. For example, the fluid conduit can be placed in an autofrettage fixture in which the fluid conduit is subjected to a fluid pressure of from approximately 80,000 pounds per square inch (psi) to approximately 100,000 psi, such as approximately 90,000 psi, and then removed from the autofrettage fixture. In other embodiments, however, other suitable techniques can be used for inducing the compressive stresses or otherwise increasing the durability of the conduit. After step 520, the process 500 concludes.

Those skilled in the art will appreciate that the process 500 shown in FIG. 5 may be altered in a variety of ways. For example, the order of the steps may be rearranged; substeps may be performed in parallel; shown steps may be omitted, or other steps may be included; etc.

Figure 6:
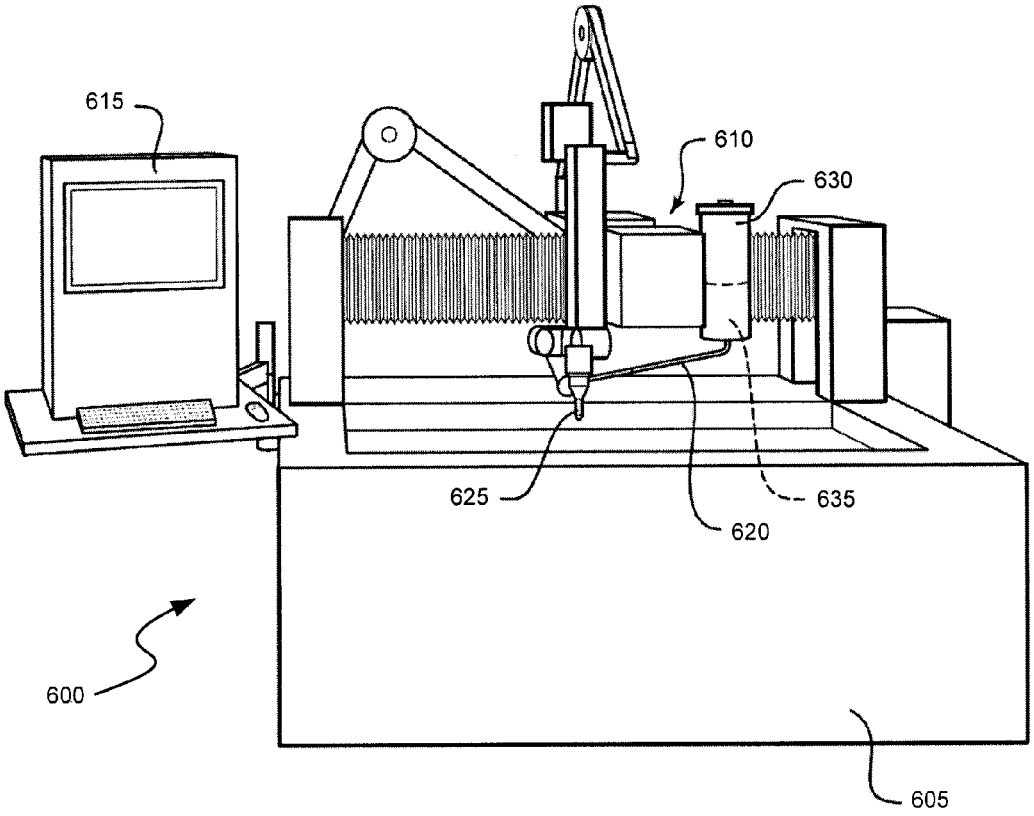
FIG. 6 is an isometric view of a waterjet cutting system that can utilize waterjet cutting devices having fluid conduits configured in accordance with embodiments of the disclosure.

FIG. 6 is an isometric view of a waterjet cutting system 600 which can utilize various embodiments of waterjet cutting devices having fluid conduits configured in accordance with the present disclosure. The waterjet cutting system 600 includes a base 605 and a mechanism 610 for moving a waterjet cutting head 625 in both the X and Y directions. The waterjet cutting system 600 can also include a pressurized water source, such as a pump (not shown in FIG. 6) that conveys highly pressurized water (e.g., water at a high pressure, such as about 15,000 pounds psi or less to about 60,000 psi or more) to the cutting head 625. The waterjet cutting system 600 also includes an abrasive container 630 and an abrasive supply conduit 620 that conveys abrasives 635 from the abrasive container 630 to the cutting head 625. The waterjet cutting system 600 can also include a controller 615 that an operator may use to program or otherwise control the waterjet cutting system 600.

Although the waterjet cutting system 600 can originally include a high pressure fluid conduit having two opposing through holes with circular cross-sections, the waterjet cutting system 600 can be retrofitted with a fluid conduit configured as described herein. A method of retrofitting the waterjet cutting system 600 can include decoupling the fluid conduit having the two opposing circular through holes from the waterjet cutting system 600, and then coupling a fluid conduit configured as described herein (e.g., FIGS. 1-4C) to the waterjet cutting system 600.

From the foregoing, it will be appreciated that specific embodiments of the invention have been described herein for purposes of illustration, but that various modifications may be made without deviating from the scope of the invention. For example, the through holes are shown and described as perpendicular to the longitudinal axis A of the fluid conduits (the lines extending through the centers of the through holes are perpendicular to the longitudinal axis A of the fluid conduits). However, the through holes can be oriented other than perpendicular to the longitudinal axis A. For example, the through holes could be at acute or obtuse angles to the longitudinal axis A (the lines extending through the centers of the through holes are at acute or obtuse angles to the longitudinal axis A). As an example of another modification, the maximum longitudinal dimensions could be oriented other than generally parallel with the longitudinal axis A. Various other configurations are of course possible.

Another modification can have the through holes 110 oriented at a 90° angle to the longitudinal axis A but with cross-sectional areas that vary from the outer surface 204 of the wall 202 to the inner surface 206 of the wall 202. For example, portions of one or more of the through holes 110 in the fluid conduits 124 can flare out from the outer surface 204 of the fluid conduit wall to the inner surface 206 of the wall 202, or conversely, can taper from the wall 202 outer surface 204 to the wall 202 inner surface 206. The other fluid conduits 324, 424 could be similarly configured.

As an example of another modification, fluid conduits as described herein can be utilized to carry pressurized gases instead of pressurized fluids. As another example, although the seals formed by the seal assemblies 120 can be considered dynamic seals, the fluid conduit may not be rotatably movable within the central passage 122 of the body 114. In such a configuration, the seal assemblies 120 can form static seals.

Those skilled in the art will recognize that numerous liquids other than water can be used, and the recitation of a jet as comprising water should not necessarily be interpreted as a limitation. For example, fluids other than water can also be employed to cut materials that cannot be in contact with water. The customary term for the process of cutting with a fluid is "water-jet cutting" and the like, but the term "water-jet cutting" is not intended to exclude cutting by abrasive jets of fluid other than water.

The present disclosure is broadly applicable to various types of conduits, vessels, and the like in a pressurized system that are configured to carry pressurized fluids or gases through a passage, have one or more through holes in the conduit that are not coaxial with the passage, and that are configured to be subject to an axial loading or axial tensile forces. Accordingly, the present disclosure is not to be limited to the embodiments described herein but is broadly applicable.

Further, while advantages associated with certain embodiments have been described in the context of those embodiments, other embodiments may also exhibit such advantages, and not all embodiments need necessarily exhibit such advantages to fall within the scope of the present disclosure. Accordingly, the inventions are not limited except as by the appended claims.

I claim:

1. A waterjet cutting system comprising:

a waterjet cutting device coupleable to a pressurized water source of the waterjet cutting system, the waterjet cutting device including:

a waterjet cutting head; and a fluid conduit configured to convey pressurized water to the waterjet cutting head, the fluid conduit including a wall having an outer surface and an inner surface, the wall defining a longitudinal passage through which the pressurized water travels, wherein the wall includes at least one through hole extending from the outer surface of the wall to the inner surface, and wherein:

the at least one through hole has a cross-sectional shape with a maximum longitudinal dimension generally parallel to the longitudinal passage and a maximum latitudinal dimension generally perpendicular to the longitudinal passage, and the maximum longitudinal dimension is greater than the maximum latitudinal dimension.

2. The waterjet cutting system of claim 1 wherein the at least one through hole has a generally elliptical cross-section.

3. The waterjet cutting system of claim 1 wherein the at least one through hole is a first through hole in a first portion of the wall, and wherein the wall further includes a second through hole in a second, opposing portion of the wall, the second through hole extending from the outer surface of the wall to the inner surface, and wherein the second through hole has a maximum longitudinal dimension and a maximum latitudinal dimension generally similar to those of the first through hole.

4. A waterjet cutting system comprising:

a waterjet cutting device coupleable to a pressurized water source of the waterjet cutting system, the waterjet cutting device including:

a waterjet cutting head; and a fluid conduit configured to convey pressurized water to the waterjet cutting head, the fluid conduit including a wall defining a longitudinal passage through which the pressurized water travels, wherein the wall includes one or more longitudinally aligned through holes in communication with the longitudinal passage, and wherein:

each of the one or more through holes has a cross-sectional shape with a maximum longitudinal dimension generally parallel to the longitudinal passage and a maximum latitudinal dimension generally perpendicular to the longitudinal passage, and the sum of the maximum longitudinal dimensions is greater than the largest maximum latitudinal dimension.

5. The waterjet cutting system of claim 4 wherein the one or more through holes includes a through hole having a generally elliptical cross-section.

6. The waterjet cutting system of claim 4 wherein the one or more through hole includes three through holes, wherein each of the three through holes has a generally circular cross-section.

7. The waterjet cutting system of claim 4 wherein the one or more longitudinally aligned through holes is a first set of longitudinally aligned through holes in a first portion of the wall, wherein the wall further includes a second set of one or more longitudinally aligned through holes in a second, opposing portion of the wall, and wherein the one or more through holes in the second set have maximum longitudinal and latitudinal dimensions generally similar to the maximum longitudinal and latitudinal dimensions of the one or more through holes in the first set.

8. A fluid jet cutting device coupleable to a fluid jet cutting system, the fluid jet cutting device comprising:

a fluid jet cutting head;

a housing coupled to the fluid jet cutting head, the housing including:

a body including an outer surface, a central passage, a fluid inlet aperture in the outer surface, and a fluid inlet passage extending from the fluid inlet aperture to the central passage; and a fluid conduit including a first portion positioned within the central passage and a second portion coupled to the fluid jet cutting head, one or more openings in the first portion proximate to the fluid inlet passage, and a longitudinal passage extending from the first portion to the second portion, wherein:

each of the one or more openings is in communication with the longitudinal passage, each of the one or more openings has a maximum longitudinal dimension generally parallel to the longitudinal passage and a maximum latitudinal dimension generally perpendicular to the longitudinal passage, and the sum of the maximum longitudinal dimensions is greater than the largest maximum latitudinal dimension.

9. The fluid jet cutting device of claim 8 wherein the one or more openings includes an opening having a generally elliptical cross-section.

10. The fluid jet cutting device of claim 8 wherein the one or more openings includes three openings, and wherein each of the three openings has a generally circular cross-section.

11. The fluid jet cutting device of claim 8 wherein the body further has first and second seal assemblies surrounding the fluid conduit proximate to the one or more openings, and wherein the fluid conduit is rotatably movable within the central passage of the body.

* * * * *